US012601164B2

(12) United States Patent
Akiyoshi et al.

(10) Patent No.: US 12,601,164 B2
(45) Date of Patent: Apr. 14, 2026

(54) TOILET DEVICE

(71) Applicant: TOTO LTD., Kitakyushu (JP)

(72) Inventors: Keita Akiyoshi, Kitakyushu (JP); Aya Hasegawa, Kitakyushu (JP); Shohei Ogawa, Kitakyushu (JP); Ryuichi Kumamoto, Kitakyushu (JP); Hiroyoshi Matsushita, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 195 days.

(21) Appl. No.: 18/670,906

(22) Filed: May 22, 2024

(65) Prior Publication Data

US 2024/0426093 A1 Dec. 26, 2024

(30) Foreign Application Priority Data

Jun. 20, 2023 (JP) ..... 2023-100636
Feb. 6, 2024 (JP) ..... 2024-016575

(51) Int. Cl.
*E03D 9/052* (2006.01)

(52) U.S. Cl.
CPC ..... *E03D 9/052* (2013.01); *E03D 2201/20* (2013.01)

(58) Field of Classification Search
None
See application file for complete search history.

(56) References Cited

FOREIGN PATENT DOCUMENTS

| | | | |
|---|---|---|---|
| JP | 2002-266406 | A | 9/2002 |
| JP | 2002-294815 | A | 10/2002 |
| JP | 2007-092396 | A | 4/2007 |
| JP | 2011-052397 | A | 3/2011 |
| JP | 2018-028233 | A | 2/2018 |

*Primary Examiner* — Christine J Skubinna
(74) *Attorney, Agent, or Firm* — McDonald Hopkins LLC

(57) ABSTRACT

A toilet device includes a case and a deodorizing device. The deodorizing device includes a first opening part, a second opening part, a third opening part, a suction fan, a first deodorizing path part, and a second deodorizing path part. The first opening part is configured to suction air outside the case. The second opening part is configured to suction air inside the case. The third opening part is configured to exhaust out of the case air suctioned by the first and second openings. The suction fan is configured to suction the air outside and inside the case through the first and second opening parts. The first deodorizing path part connects the suction fan with the first and second opening parts. The second deodorizing path part connects the suction fan and the third opening part. The second opening part has a smaller opening area than the first opening part.

8 Claims, 10 Drawing Sheets

TOILET DEVICE

CROSS-REFERENCE TO RELATED APPLICATIONS

This application is based upon and claims the benefit of priority from Japanese Patent Application No. 2023-100636, filed on Jun. 20, 2023; the entire contents of which are incorporated herein by reference.

This application is based upon and claims the benefit of priority from Japanese Patent Application No. 2024-016575, filed on Feb. 6, 2024; the entire contents of which are incorporated herein by reference.

FIELD

Embodiments described herein relate generally to a toilet device.

BACKGROUND

Corrosion of electronic components and the like inside the case of a toilet device may cause discrepancies such as unintended operations of the toilet device or failure of the toilet device to operate. Condensation due to moisture is considered to be one cause of such corrosion. In a toilet device known in the art, to suppress such condensation due to moisture, an opening part for suctioning air that is inside the case is disposed in the deodorizing device for suctioning air that is inside the toilet; and the moisture inside the case is suctioned through the opening part (2002-266406 JP A and 2007-092396 JP A).

In the toilet device described above, there is a possibility that the opening part that is disposed in the deodorizing device and suctions the air that is inside the case may degrade the air suction ability of the opening part suctioning the air that is inside the toilet. Sufficient deodorizing performance may not be obtained if the suction ability is degraded.

SUMMARY

According to the embodiment, a toilet device includes a case and a deodorizing device. The deodorizing device is disposed inside the case. The deodorizing device includes a first opening part, a second opening part, a third opening part, a suction fan, a first deodorizing path part, and a second deodorizing path part. The first opening part is configured to suction air outside the case. The second opening part is configured to suction air inside the case. The third opening part is configured to exhaust out of the case air suctioned by the first and second openings. The suction fan is configured to suction the air outside and inside the case through the first and second opening parts. The first deodorizing path part connects the suction fan with the first and second opening parts. The second deodorizing path part connects the suction fan and the third opening part. The second opening part has a smaller opening area than the first opening part.

DETAILED DESCRIPTION

Figure 1:
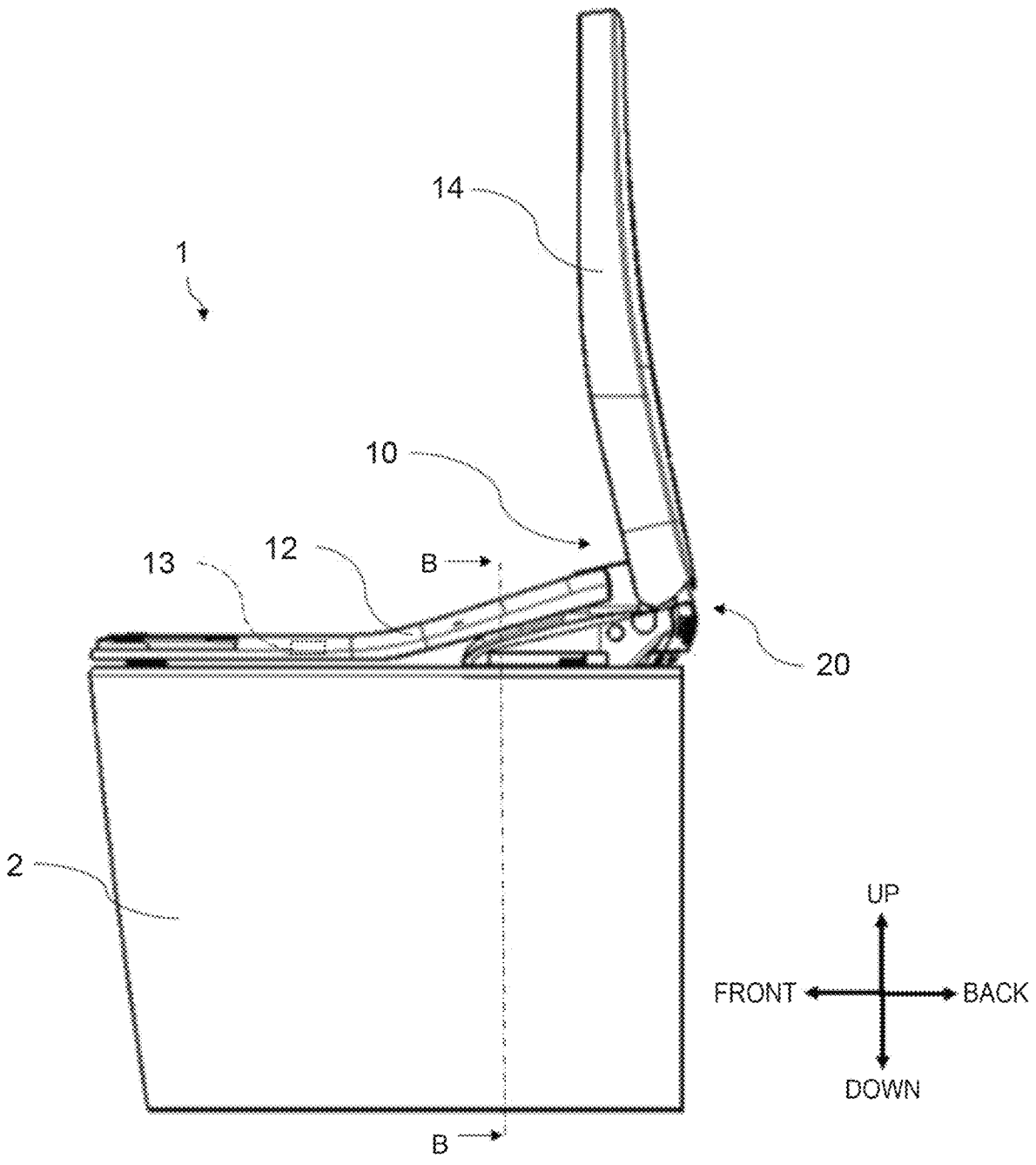
FIG. 1 is a side view illustrating a toilet unit including a toilet device according to an embodiment of the invention.

A toilet device according to an aspect of an embodiment of the invention includes a case, and a deodorizing device disposed inside the case; the deodorizing device includes a first opening part configured to suction air outside the case, a second opening part configured to suction air inside the case, a third opening part configured to exhaust, out of the case, air suctioned by the first and second opening parts, a suction fan configured to suction the air outside and inside the case through the first and second opening parts, a first deodorizing path part connecting the suction fan with the first and second opening parts, and a second deodorizing path part connecting the suction fan and the third opening part; and the second opening part has a smaller opening area than the first opening part.

According to the toilet device according to the aspect of the embodiment, the second opening part has a smaller opening area than the first opening part. Therefore, the airflow rate suctioned through the second opening part when the suction fan is driven can be less than the airflow rate suctioned through the first opening part. Accordingly, degradation of the suction ability of the first opening part caused by disposing the second opening part in the deodorizing device can be suppressed.

A toilet device according to an aspect of an embodiment further includes a human body detection sensor configured to detect a human body; and the suction fan rotates at a prescribed rotational speed from when the human body detection sensor changes from a state of detecting a human body to a state of not detecting the human body until a first period has elapsed, and rotates at a lower rotational speed than the prescribed rotational speed from when the first period has elapsed until a second period has elapsed.

According to the toilet device according to the aspect of the embodiment, the suction fan rotates at a prescribed rotational speed from when the human body detection sensor changes from a state of detecting a human body to a state of not detecting the human body until the first period has elapsed, and rotates at a lower rotational speed than the prescribed rotational speed from when the first period has elapsed until the second period has elapsed. As a result, the driving noise of the suction fan in the second period can be less than the driving noise of the suction fan in the first period. Therefore, condensation inside the case can be suppressed while suppressing discomfort due to the driving noise of the suction fan even when a user is inside the toilet room in which the toilet device is disposed when moisture is being suctioned in the second period, and even when the user switches with another user entering the toilet room after the user is done using the toilet device.

A toilet device according to an aspect of an embodiment further includes a human body detection sensor configured to detect a human body; and the suction fan rotates at a prescribed rotational speed from when the human body detection sensor changes from a state of detecting a human body to a state of not detecting the human body until a first period has elapsed, rotates at a higher rotational speed than the prescribed rotational speed from when the first period has elapsed until a second period has elapsed, and rotates at a lower rotational speed than the prescribed rotational speed from when the second period has elapsed until a third period has elapsed.

When a person dwells inside the toilet room after the toilet flushing ends, or when a person enters the toilet room and switches with another person after the other person has used the toilet and the toilet flushing has ended, there is a risk that the driving noise of the suction fan may cause discomfort. On the other hand, because the rotational speed of the intake fan when the person is seated is suppressed so that the seated person does not experience discomfort, it is favorable to suction offensive odors and/or moisture as much as possible after the person has left the seat and while nobody is inside the toilet room. Therefore, according to the toilet device according to the aspect of the embodiment, condensation inside the case can be further suppressed by improving the suction ability of the suction fan while suppressing discomfort of the person due to the driving noise of the suction fan.

In a toilet device according to an aspect of an embodiment, the second period is shorter than the third period.

According to the toilet device according to the aspect of the embodiment, by setting the period of the rotational speed that is higher than the prescribed rotational speed to be shorter than the period of the rotational speed that is lower than the prescribed rotational speed, the suction fan can be prevented from being driven at a higher rotational speed than the prescribed rotational speed for a long period of time; and discomfort of the person due to the driving noise can be further suppressed.

In a toilet device according to an aspect of an embodiment, the case further includes a fourth opening part configured to pass the air from outside the case and inside the case.

According to the toilet device according to the aspect of the embodiment, the case further includes a fourth opening part configured to pass the air from outside the case and inside the case. As a result, the air inside the case easily flows out, the air outside the case easily flows in, and the air pressure difference inside and outside the case can be reduced. For example, when the case has a gap connecting the interior and outside of the case, and when the case interior has a negative pressure due to the air being suctioned through the second opening part, there is a risk that moisture may flow into the case more easily through the gap; however, by reducing the air pressure difference between the interior and outside of the case, the flow of the moisture into the case can be suppressed.

In a toilet device according to an aspect of an embodiment, a filter that includes a mesh is disposed in the fourth opening part.

According to the toilet device according to the aspect of the embodiment, a filter that includes a mesh is disposed in the fourth opening part. Therefore, for example, even when the case interior has a negative pressure, dirt and/or dust can be prevented from passing through the fourth opening part and entering the case interior.

In a toilet device according to an aspect of an embodiment, the deodorizing device further includes a rib configured to suppress suction of air from a prescribed direction toward the second opening part.

According to the toilet device according to the aspect of the embodiment, the deodorizing device includes a rib configured to suppress suction of air from a prescribed direction toward the second opening part. As a result, the rib can suppress suction from the prescribed direction toward the second opening part, and can preferentially suction air from a direction other than the prescribed direction. For example, the suction of air from a direction connecting the second opening part and a location inside the case at which condensation does not easily occur can be suppressed, and the moisture at a location inside the case at which condensation easily occurs can be preferentially suctioned. Accordingly, condensation inside the case can be suppressed, and constraints of the component layout inside the case such as needing to mount electronic components only at locations inside the case at which condensation does not easily occur, etc., can be suppressed. A location inside the case at which condensation easily occurs is, for example, a location that tends to be cool because no heat-generating unit is disposed nearby, etc.; and a location inside the case at which condensation does not easily occur is, for example, a location having a heat-generating unit disposed nearby.

A toilet device according to an aspect of an embodiment further includes a human body detection sensor configured to detect a human body; the suction fan rotates at a prescribed rotational speed when the human body detection sensor detects a human body; and when the human body detection sensor no longer detects the human body, the suction fan rotates at a lower rotational speed than the prescribed rotational speed from when the human body is no longer detected until a prescribed period has elapsed.

According to the toilet device according to the aspect of the embodiment, condensation inside the case can be suppressed while suppressing discomfort due to the driving noise of the suction fan, even when other users frequently enter the toilet room and switch with the user after the use by the user has ended.

Embodiments of the invention will now be described with reference to the drawings. Similar components in the drawings are marked with the same reference numerals; and a detailed description is omitted as appropriate.

FIG. 1 is a side view illustrating a toilet unit including a toilet device according to an embodiment of the invention. As shown in FIG. 1, the toilet unit 1 is disposed inside a toilet room, and includes a toilet 2, and the toilet device 10 mounted to the upper surface of the toilet 2. The toilet device 10 includes a toilet seat 12, a toilet lid 14, and a case 20. The toilet seat 12 and the toilet lid 14 each are pivotally supported to be openable and closable with respect to the case 20. In this specification, up/upward/above, down/downward/below, front/frontward, back/backward, right, and left when viewed by a user sitting on the toilet seat 12 with the back of the user facing the toilet lid 14 in the open state are respectively taken as "up/upward/above", "down/downward/below", "front/frontward", "back/backward", "right", and "left".

The toilet device 10 is mounted to the upper surface of the toilet 2 at the back side. The toilet device 10 may be mounted as a continuous body with the toilet 2, or may be detachably mounted to the toilet 2. The toilet device 10 includes the case 20 formed in a box-like shape having a hollow interior, and a deodorizing device 40 that is disposed inside the case 20 and includes a function of reducing offensive odors.

An opening/closing unit (not illustrated) that controls the open/close operation of the toilet lid 14 and/or the toilet seat 12, a washing unit (not illustrated) that washes a human body private part, a communication unit (not illustrated) configured to communicate with an operation unit such as a remote control, etc., are embedded inside the case 20 as necessary. The case 20 pivotally supports the toilet seat 12 and the toilet lid 14 to be rotatable at the back side. The toilet lid 14 may be included in the toilet device 10 as necessary, and may not be included.

The toilet seat 12 includes a seating detection sensor 13 that is a human body detection sensor configured to detect a human body and detects whether or not the user is seated. The seating detection sensor 13 detects the state in which the human body is detected, that is, the state in which the user is seated. The seating detection sensor 13 may detect the state in which the human body is not detected, that is, the state in which the user is not seated (the state of having left the seat). The location at which the seating detection sensor is disposed is not limited to the toilet seat and may be, for example, the case. Instead of a seating detection sensor, for example, a room entrance detection sensor that detects a human body entering the toilet room and/or a proximity detection sensor detecting a human body approaching the toilet device may be used as the human body detection sensor.

Figure 2:
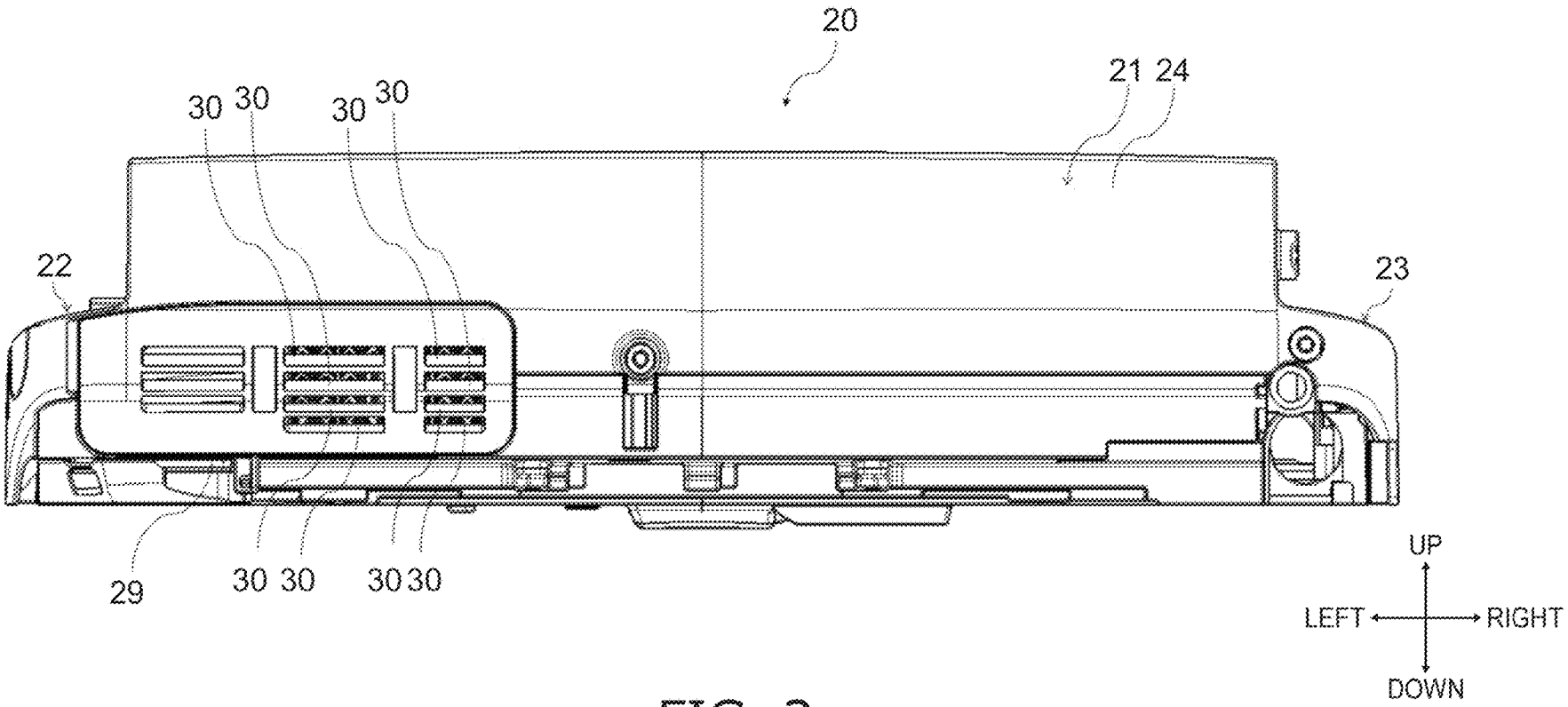
FIG. 2 is a back view illustrating the appearance of the toilet device according to the embodiment of the invention.

FIG. 2 is a back view illustrating the appearance of the toilet device according to the embodiment of the invention.

Figure 3:
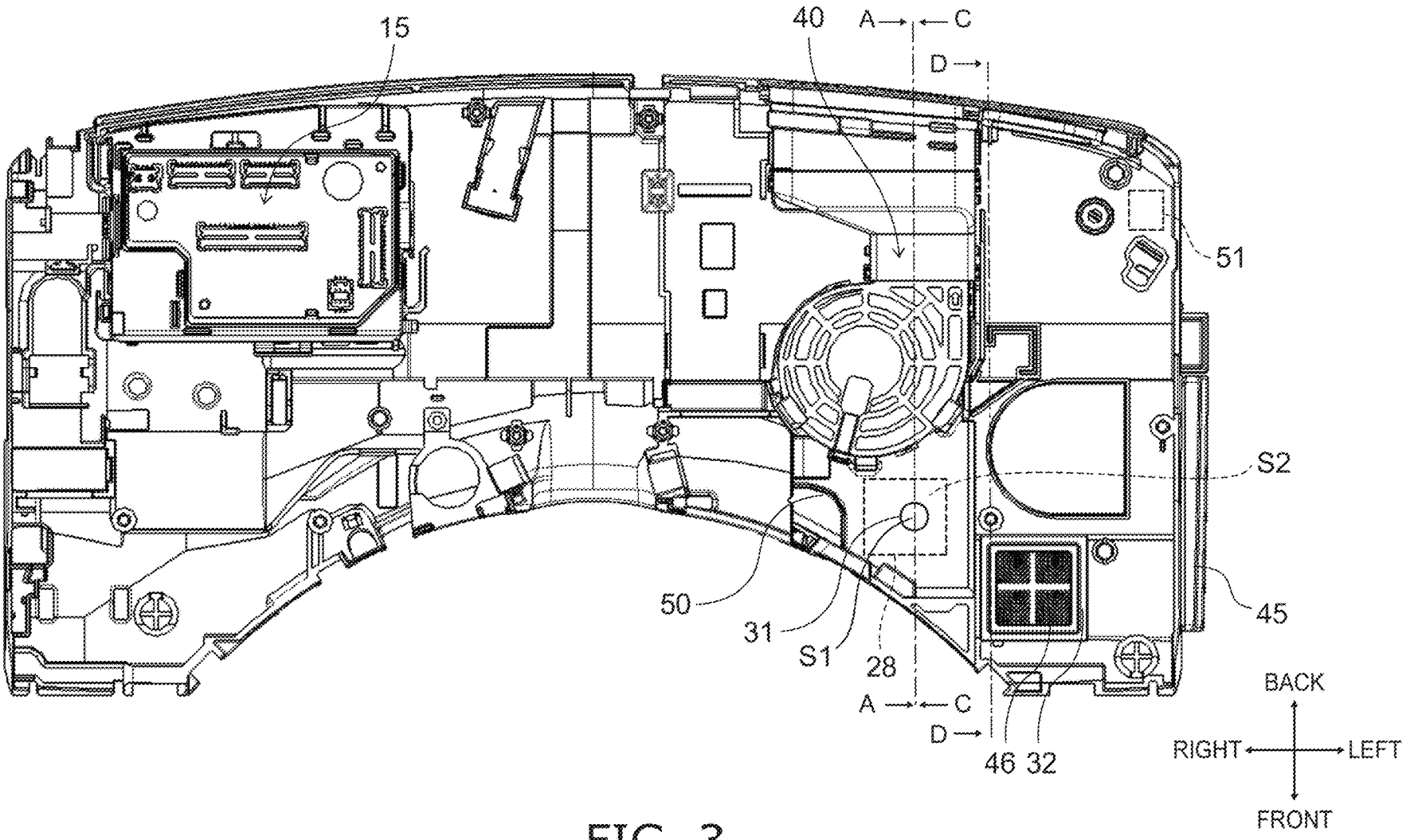
FIG. 3 is a top view illustrating the interior of the case of the toilet device according to the embodiment of the invention in which the case is not illustrated.

FIG. 3 is a top view illustrating the interior of the case of the toilet device according to the embodiment of the invention in which the case is not illustrated.

Figure 4:
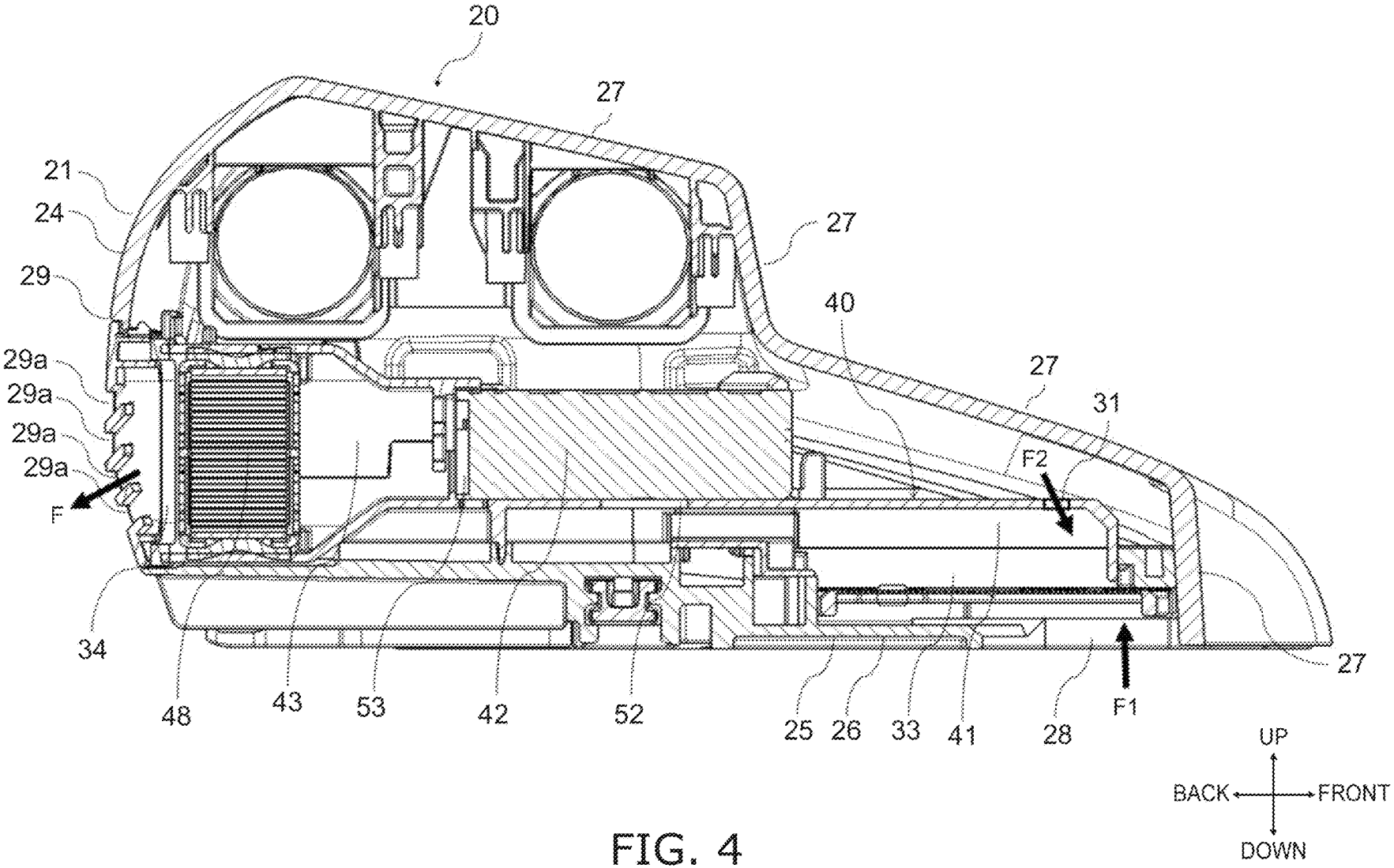
FIG. 4 is a cross-sectional view when viewed along the arrow A-A direction of FIG. 3, in which the case is illustrated.

FIG. 4 is a cross-sectional view when viewed along the arrow A-A direction of FIG. 3, in which the case is illustrated.

Figure 5:
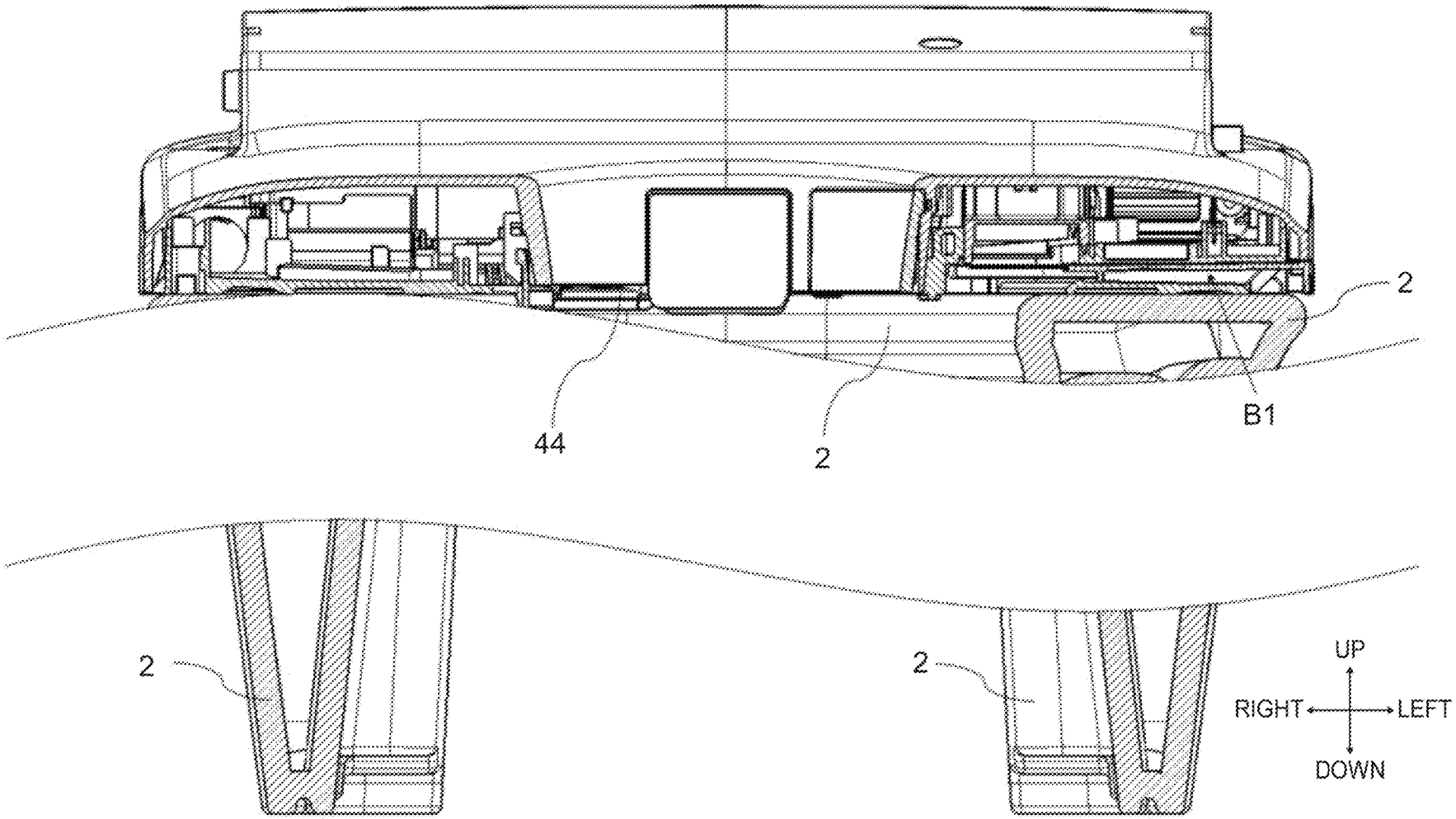
FIG. 5 is a cross-sectional view when viewed along the arrow B-B direction of FIG. 1.

FIG. 5 is a cross-sectional view when viewed along the arrow B-B direction of FIG. 1.

Figure 6:
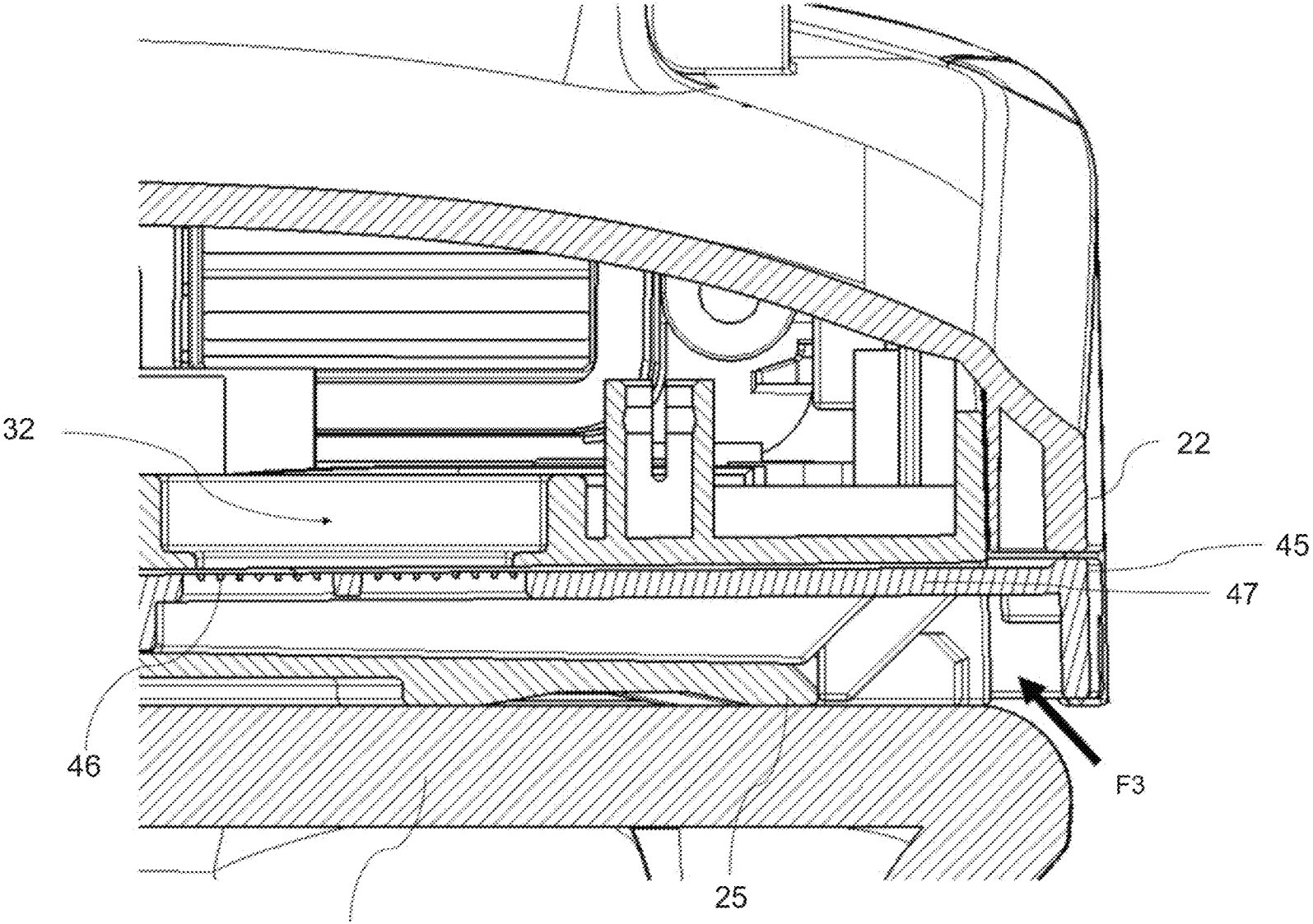
FIG. 6 is an enlarged view of the arrow B1 vicinity of FIG. 5.

FIG. 6 is an enlarged view of the arrow B1 vicinity of FIG. 5.

Figure 7:
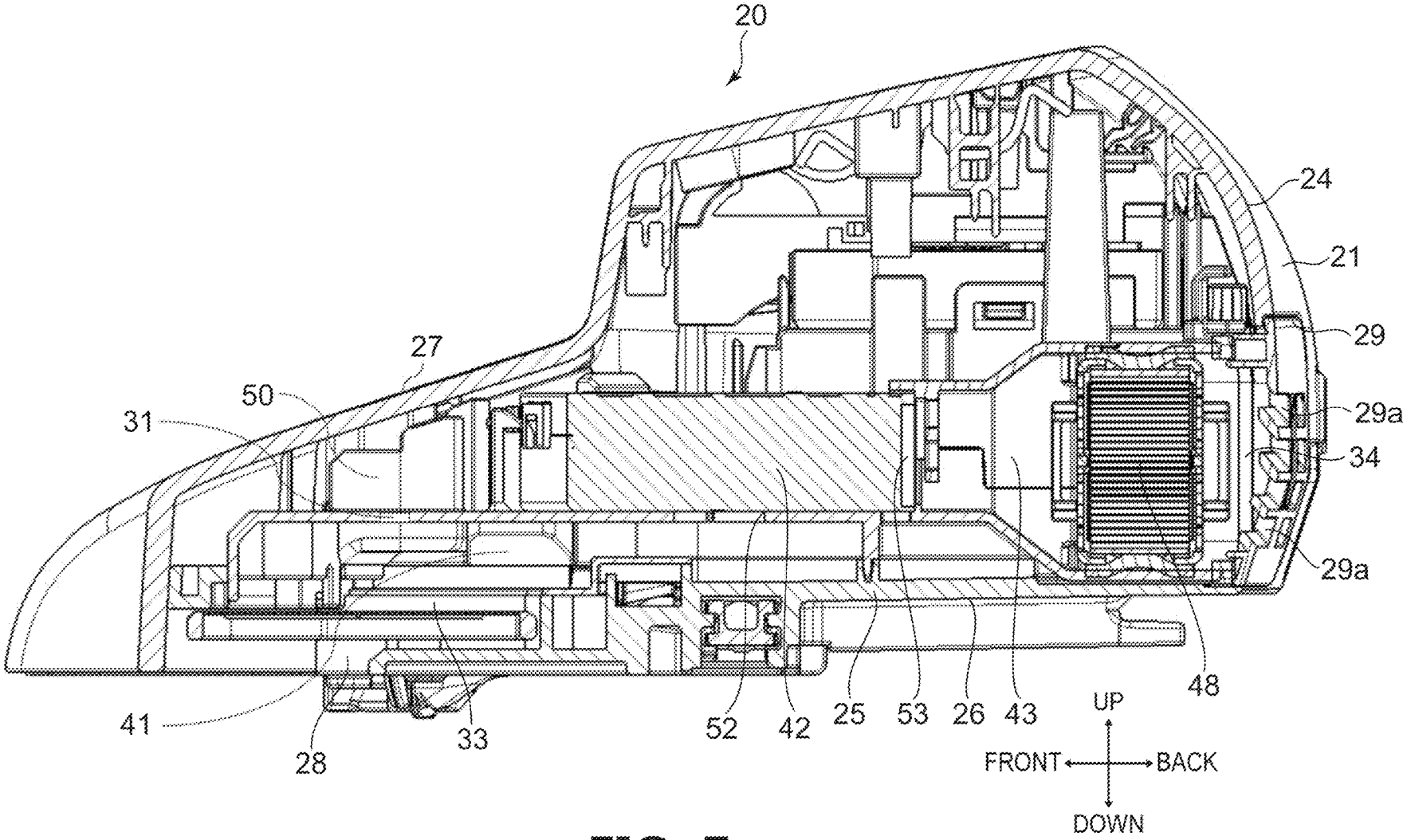
FIG. 7 is a cross-sectional view when viewed along the arrow C-C direction of FIG. 3, in which the case is illustrated.

FIG. 7 is a cross-sectional view when viewed along the arrow C-C direction of FIG. 3, in which the case is illustrated.

Figure 8:
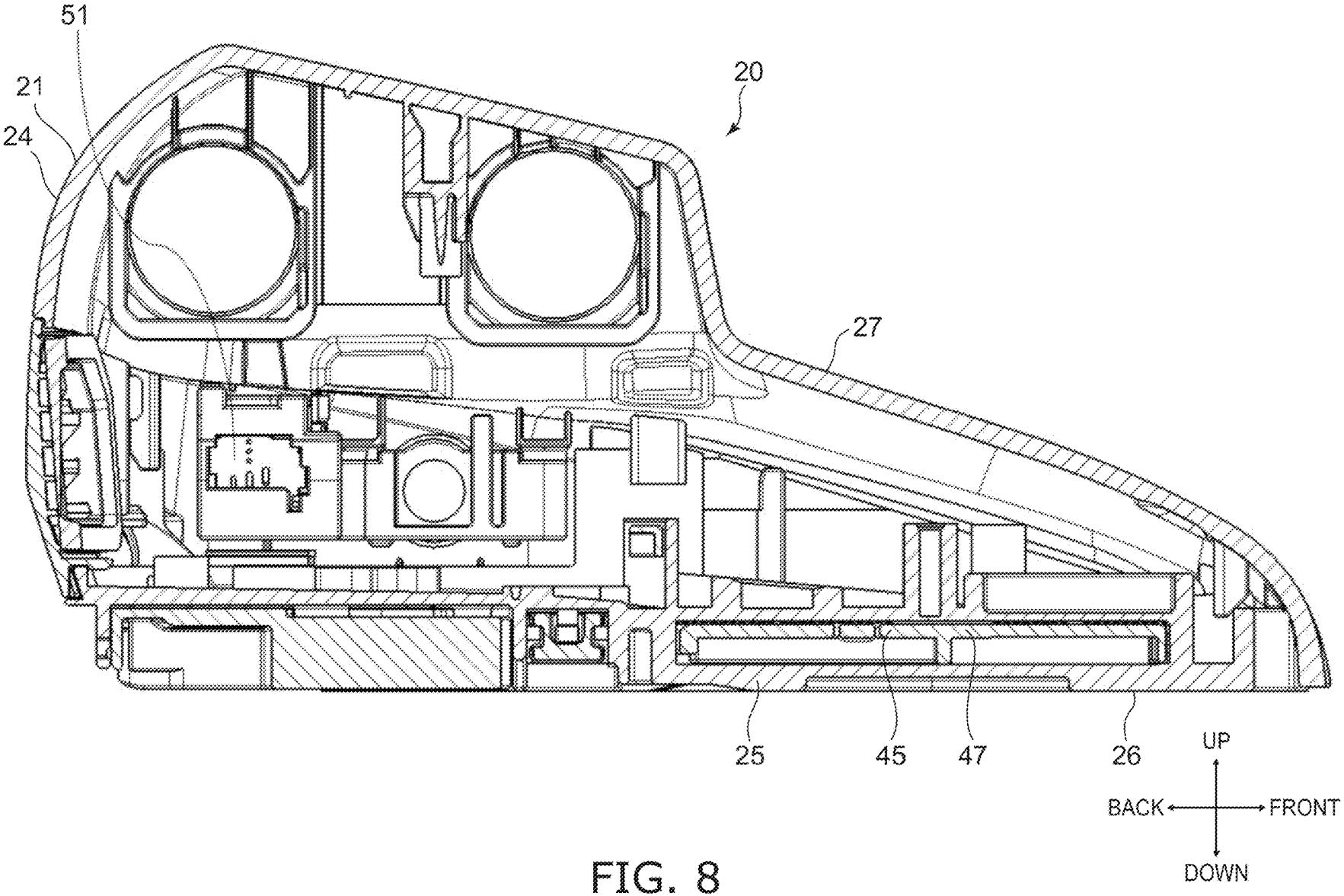
FIG. 8 is a cross-sectional view when viewed along the arrow D-D direction of FIG. 3, in which the case is illustrated.

FIG. 8 is a cross-sectional view when viewed along the arrow D-D direction of FIG. 3, in which the case is illustrated.

As shown in FIGS. 2 and 4, the case 20 includes a side surface part 21, a lower surface part 26 sealing the lower end of the side surface part 21, and an upper surface part 27 sealing the upper end of the side surface part 21. The side surface part 21 includes a left side plate 22 and a right side plate 23 facing each other in the lateral direction, and a back side plate 24 connecting the left side plate 22 and the right side plate 23 at the back end side. The lower surface part 26 also includes a lower side plate 25 connecting the left side plate 22, the right side plate 23, and the back side plate 24. As shown in FIGS. 4 and 6, the lower side plate 25 includes a first opening part 28 and a fourth opening part 32 connecting the interior and outside of the case 20. As shown in FIG. 4, the back side plate 24 includes a third opening part 29 connecting the interior and outside of the case 20. Here, the first opening part 28 is an opening part configured to suction air that is outside the case 20, is connected to a first deodorizing path part 41 of the deodorizing device 40 inside the case 20, and is used by the deodorizing device 40 to suction offensive odors of the toilet 2. The third opening part 29 is an opening part configured to exhaust the suctioned air out of the case 20, is connected to a second deodorizing path part 43 of the deodorizing device 40 inside the case 20, and is used by the deodorizing device 40 to discharge air F of which the offensive odors have been reduced. The fourth opening part 32 is an opening part configured to pass the air from outside the case 20 and inside the case 20, and is used to regulate the air pressure inside the case 20.

According to the embodiment as shown in FIG. 3, the first opening part 28 is formed at the front left side of the toilet device 10 above the bowl surface of the toilet 2. As long as the first opening part 28 is configured to suction the air that is inside the toilet 2, the first opening part 28 may be formed by modifying the position to the right side of the toilet device 10, etc., as necessary.

According to the embodiment as shown in FIG. 2, the third opening part 29 is formed at the left side of the back side plate 24. The third opening part 29 may be formed in the left side plate 22, the right side plate 23, etc., as necessary.

According to the embodiment as shown in FIG. 6, the fourth opening part 32 is formed at the left side of the toilet device 10, and connects the outside of the toilet 2 and the interior of the case 20. The fourth opening part 32 may be formed outside the toilet 2 at the right side and/or back of the toilet device 10 as necessary.

The third opening part 29 includes multiple louvers 30. As shown in FIG. 2, the louvers 30 are made of plate bodies extending in the lateral direction inside the third opening part 29, and are formed at a prescribed spacing in the vertical direction. As shown in FIG. 4, each louver 30 is inclined downward from the interior toward the outside of the case 20.

As shown in FIGS. 2 and 4, the third opening part 29 includes multiple louver openings 29*a* partitioned by the louvers 30. Eight louver openings 29*a* are included in the embodiment. The louver openings 29*a* are not limited to eight. As shown in FIG. 4, the air F of which the offensive odors have been reduced is discharged by the deodorizing device 40 obliquely downward from the louver openings 29*a* along the louvers 30.

The case 20 may be wiped with a wet dust cloth when cleaned by a person, or may be sprayed with water from a shower, etc. In such a case, the water may penetrate through the louver openings 29*a*. However, the louvers 30 are inclined upward from the outside toward the interior of the case 20, making it difficult for the water to penetrate the interior of the case 20.

As shown in FIG. 4, the deodorizing device 40 is disposed inside the case 20. The deodorizing device 40 includes a first suction opening part 33 configured to suction the air that is inside the toilet 2, and a second exhaust opening part 34 configured to discharge the suctioned air; the first suction opening part 33 is connected with the first opening part 28 when mounted inside the case 20; and the second exhaust opening part 34 is connected with the third opening part 29 when mounted inside the case 20. In these connections, for example, packing is sandwiched between the first suction opening part 33 and the first opening part 28 and between the second exhaust opening part 34 and the third opening part 29 to suppress air leaks. The first suction opening part 33 and the first opening part 28 may be formed to have a continuous body, or the first suction opening part may be formed to extend to the lower side plate of the case and may function as the first opening part. By such configurations, the first suction opening part can be configured to suction the air that is outside the case by itself or by having a continuous body with the first opening part.

Similarly, the second exhaust opening part 34 and the third opening part 29 may be formed to have a continuous body, or the second exhaust opening part may be formed to extend to the back side plate of the case and may function as the third opening part. By such configurations, the second exhaust opening part can be configured to exhaust the air suctioned by the first and second opening parts out of the case by itself or by having a continuous body with the third opening part.

The deodorizing device 40 deodorizes the suctioned air and discharges the air from the third opening part 29. Specifically, the deodorizing device 40 suctions air F1 that is inside the toilet 2 and air F2 that is inside the case 20. Subsequently, the deodorizing device 40 reduces the odorous components of feces, urine, etc., included in the suctioned air, and discharges the deodorized air F outside from the third opening part 29 (the louver openings 29*a*) of the case 20. Similarly, the moisture included in the air suctioned through the interior of the toilet device 10 also is discharged outside from the third opening part 29 (the louver openings 29*a*) of the case 20. The deodorizing device 40 includes the first deodorizing path part 41, a fan 42, the second deodorizing path part 43, and a deodorizing catalyst 48.

As shown in FIG. 3, a controller 15 is disposed inside the case 20. When the seating detection sensor 13 detects that the user is seated, the controller 15 can command the units embedded inside the case 20 to operate, such as by transmitting a command to a toilet seat heating unit (not illustrated) controlling the temperature of the toilet seat surface of the toilet seat 12 to raise the temperature of the toilet seat surface of the toilet seat 12.

As shown in FIG. 4, the fan 42 is positioned inside the case 20, and is disposed at the downstream side of the first deodorizing path part 41 and at the upstream side of the second deodorizing path part 43. The fan 42 is a suction fan configured to suction the air that is inside the toilet 2, and is a sirocco fan in the embodiment. The fan 42 is disposed at the upper surface of the first deodorizing path part 41 at the downstream side, is connected with a second suction opening part 52 formed at the upper surface of the first deodorizing path part 41 at the downstream side, and suctions air upward from below. The fan 42 is disposed at the front surface of the second deodorizing path part 43 at the upstream end, is connected with a first exhaust opening part 53 formed at the front surface of the second deodorizing path part 43 at the upstream side, and exhausts the suctioned air backward. An axial fan may be used as the fan 42. By driving the fan 42, the air F1 including offensive odors of the toilet 2 interior and the air F2 including moisture of the toilet device 10 interior are suctioned through the first deodorizing path part 41 into the second deodorizing path part 43.

The controller 15 also can transmit a command to the fan 42 to drive the fan 42 at a predesignated timing and at a designated rotational speed. For example, a command can be transmitted to the fan 42 to rotate at a prescribed rotational speed for a first period from when the user leaves the toilet seat 12, and rotate at a lower rotational speed than the prescribed rotational speed from when the first period has elapsed until a second period has elapsed. The first period is, for example, 2 minutes; and the second period is, for example, longer than the first period, e.g., 30 minutes. The prescribed rotational speed in the first period is, for example, 3,700 rpm; and the rotational speed that is lower than the prescribed rotational speed in the second period is, for example, 1,900 rpm. The drive control of the fan 42 performed by the controller 15 is described below in detail.

The first deodorizing path part 41, the fan 42, and the second deodorizing path part 43 connect between the first opening part 28 and the third opening part 29. The first deodorizing path part 41 is a duct that passes the air F1 suctioned by the fan 42 through the first opening part 28 toward the fan 42. As shown in FIGS. 3 and 4, a rib 50 and a second opening part 31 that connects the interior of the case 20 and the interior of the first deodorizing path part 41 are disposed at the upper surface of the first deodorizing path part 41. Therefore, the first deodorizing path part 41 can suction air not only through the first opening part 28 but also through the second opening part 31. The second deodorizing path part 43 is a duct that passes the air discharged from the fan 42 toward the third opening part 29. The odorous components of the air F1 that is suctioned by the fan 42 and includes odorous components of the toilet 2 interior are reduced by the deodorizing catalyst 48 disposed partway through the second deodorizing path part 43; and the deodorized air F is discharged from the third opening part 29. Similarly, the air F2 that is suctioned by the fan 42 and includes the moisture of the toilet device 10 interior also is discharged from the third opening part 29.

According to the embodiment as shown in FIGS. 3 and 4, the second opening part 31 is formed at the upper surface of the first deodorizing path part 41. The second opening part 31 may be formed at the side surface of the first deodorizing path part 41 as necessary. An opening area S1 of the second opening part 31 is less than an opening area S2 of the first opening part 28. It is favorable for the opening area S1 to be about 1/20 of the opening area S2; for example, the opening area S1 is 60 $mm^2$ (square millimeters); and the opening area S2 is 1,200 $mm^2$ (square millimeters).

As shown in FIG. 6, the fourth opening part 32 is configured to pass the air from inside the case 20 and outside the case 20. According to the embodiment, the fourth opening part 32 is formed at the left side of the lower side plate 25. When the air pressure inside the case 20 fluctuates, the fourth opening part 32 intakes air F3 that is outside the case 20 or discharges air that is inside the toilet device 10 to prevent the air pressure inside the case 20 from deviating from a constant air pressure.

As shown in FIG. 5, a gap 44 that connects the interior and outside of the case 20 is formed in the case 20 at the toilet 2 interior side. When the case 20 includes the gap 44, etc., there is a risk that moisture may flow more easily into the case 20 through the gap 44, etc., when the interior of the case 20 has a negative pressure. By reducing the air pressure difference between the interior and outside of the case 20, the fourth opening part 32 can suppress the flow of moisture into the case 20. Because seal water is formed inside the toilet 2, particularly when there is a gap at the toilet 2 interior side, moisture flows more easily into the case 20 through the gap 44, etc., when the interior of the case 20 has a negative pressure.

As shown in FIG. 6, a filter 45 includes a face plate 47 that has a size that can fit into the fourth opening part 32 and a thickness such that air can pass through the fourth opening part 32, and a mesh 46 that is disposed in the face plate 47 and traps dirt and/or dust in the air. By fitting the filter 45 into the fourth opening part 32, dirt and/or dust included in the air F3 passing through the fourth opening part 32 can be prevented from entering the interior of the case 20.

As shown in FIGS. 3 and 7, the rib 50 is a standing wall that obstructs suction toward the second opening part 31 from locations inside the case 20 where condensation does not easily occur (e.g., at the vicinity of units such as the controller 15 and the like that warm the air inside the case 20).

Figure 9:
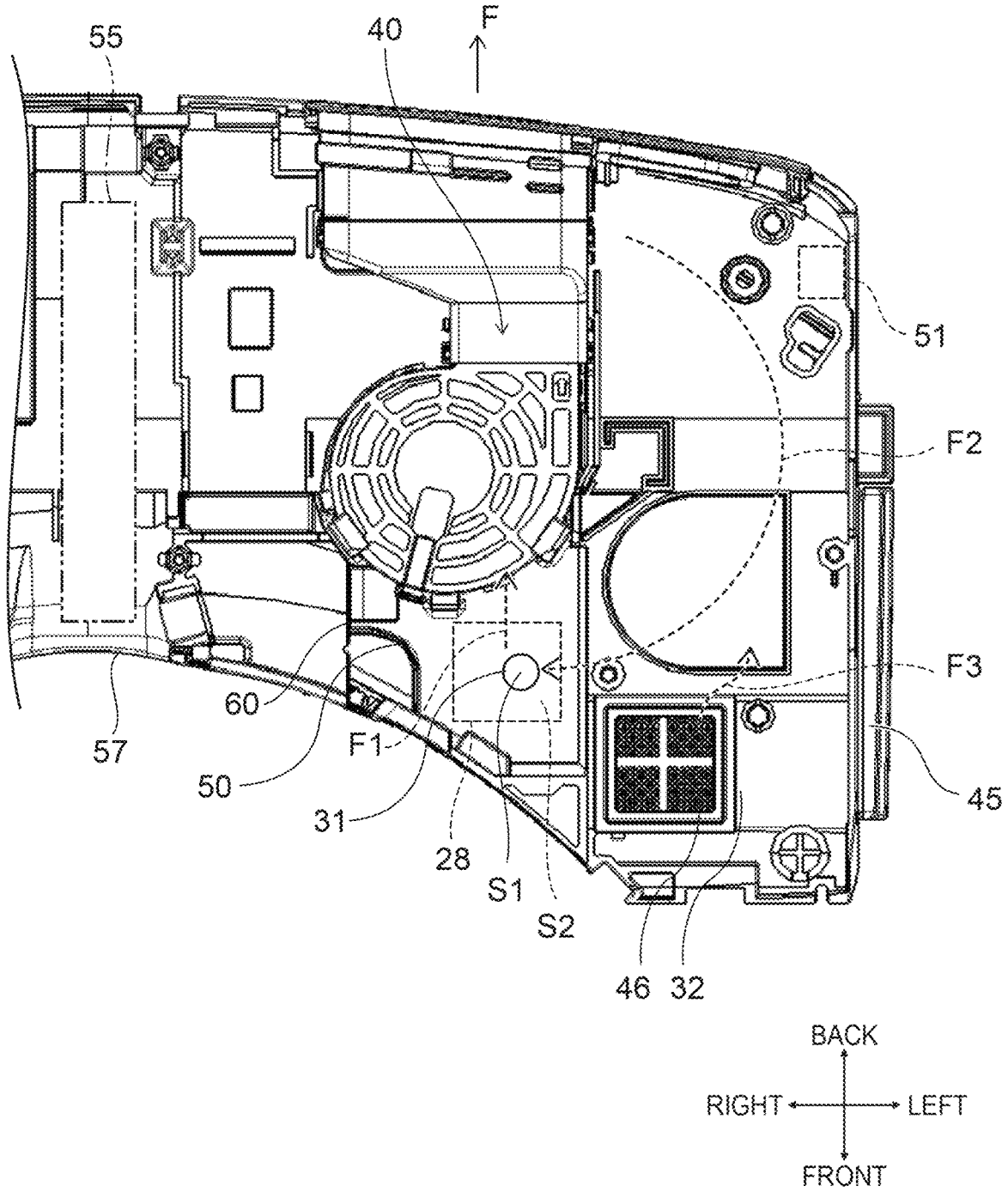
FIG. 9 is a top view illustrating the flow of air inside the case.

FIG. 9 is a top view illustrating the flow of air inside the case.

According to the embodiment as shown in FIGS. 3, 7, and 9, the rib 50 is formed at the upper surface of the first deodorizing path part 41. The rib 50 is disposed between the second opening part 31 and the controller 15 side in the lateral direction when viewed in top-view to suppress the suction of air toward the second opening part 31 from the direction connecting the center of the controller 15 and the center of the second opening part 31. As shown in FIG. 9, the rib 50 is disposed at the right side of the second opening part 31. The rib 50 is formed to protrude in an L-shape when viewed in plan to a height that does not contact the upper surface part 27 of the case 20. As a result, an opening 60 adjacent to the fan 42 at the right side of the second opening part 31 is reduced by the rib 50.

The rib 50 suppresses the suction of air toward the second opening part 31 from the prescribed direction. The prescribed direction is, for example, the direction of an advance port 57 of a private part washing nozzle 55 and the gap 44. As illustrated by the arrow in FIG. 9, the rib 50 makes it easy to suction air at the back left side of the interior of the case 20 when the second opening part 31 suctions the air F2 that is inside the case 20. As a result, for example, the rib 50 suppresses the penetration of the highly humid air from the interior of the toilet 2 into the interior of the case 20 through the advance port 57 of the private part washing nozzle 55 and the gap 44. As long as the rib 50 is inside the toilet device 10, the rib 50 may be formed outside the duct of the first deodorizing path part 41. The rib 50 may be formed in another shape such as, for example, a U-shape when viewed in plan, etc., as necessary.

The rib 50 is formed to suppress the suction of air from locations inside the case 20 where, for example, condensation does not easily occur, and is formed so that more air is preferentially suctioned from locations where condensation easily occurs than locations where condensation does not easily occur. For example, locations where condensation does not easily occur refer to units such as the controller 15 and the washing unit (not illustrated) that generate heat when operating, as well as the locations at which such units are disposed. Locations where condensation easily occurs refer to, for example, locations not adjacent to units emitting heat, such as a remote control light-receiving part 51 (see FIG. 8) that is disposed inside the case 20 at the back left side and receives signals from a remote control. The rib 50 can effectively generate the flow of air at locations where condensation easily occurs. As a result, the toilet device 10 can suppress the occurrence of condensation of electronic components such as the remote control light-receiving part 51, etc.

Figure 10:
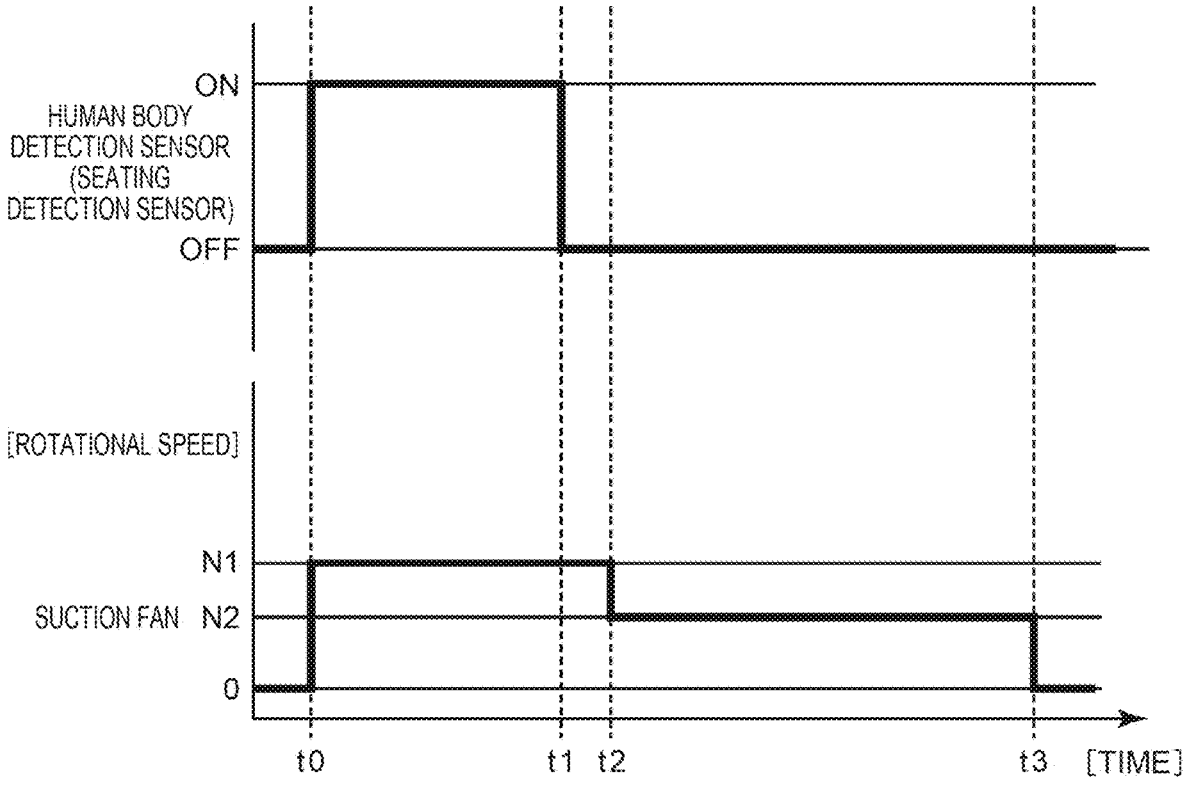
FIG. 10 is a time chart showing the detection state of the human body detection sensor and the driving state of the suction fan.

FIG. 10 is a time chart showing the detection state of the human body detection sensor and the driving state of the suction fan.

The drive control processing of the fan 42 shown in FIG. 10 is performed by the controller 15.

At a time t0, the seating detection sensor 13 (the human body detection sensor) is switched on (seated). When a seating signal transmitted from the seating detection sensor 13 is received, the controller 15 transmits a first drive signal toward the fan 42. When receiving the first drive signal, the fan 42 starts to operate at a rotational speed N1 (e.g., 3,700 rpm).

As a result, the deodorizing device 40 can reduce odorous components based on feces and/or urine of the user. The humidity inside the toilet 2 increases due to the user seated on the toilet seat 12. By starting to drive the fan 42 when the user is seated on the toilet seat 12, the toilet device 10 can suppress the increase of the humidity inside the case 20 by smoothly circulating the air inside the case 20.

At a time t1, the seating detection sensor 13 (the human body detection sensor) is switched off (unseated). When receiving an unseated signal transmitted from the seating detection sensor 13, the controller 15 measures (counts) the first period. The first period is several seconds to several minutes (e.g., 2 minutes), and is prestored in a storage part of the controller 15.

At a time t2 when the first period has elapsed from the time t1, the fan 42 is driven at a rotational speed N2 (e.g., 1,900 rpm). In other words, the controller 15 transmits a second drive signal toward the fan 42 when the first period has elapsed from when the user left the toilet seat 12. When receiving the second drive signal, the fan 42 reduces the rotational speed from the rotational speed N1 to the rotational speed N2. Also, the controller 15 measures (counts) the second period from the time t2. The second period is set to be longer than the first period, and is prestored in the storage part of the controller 15. The second period is several minutes to several tens of minutes (e.g., 30 minutes).

The period from the time t1 to the time t2 is from 0 minutes to several minutes; and the rotational speed may be reduced from the rotational speed N1 to the rotational speed N2 simultaneously with the user leaving the toilet seat 12. In other words, the first period may not be set. The controller 15 rotates the fan 42 at the prescribed rotational speed (the rotational speed N1) when the seating detection sensor 13 (the human body detection sensor) detects a human body (the time t0). Then, when the seating detection sensor 13 no longer detects the human body (the time t1), the controller 15 rotates the fan 42 at the rotational speed N2 that is less than the prescribed rotational speed from when the human body was no longer detected until a prescribed period has elapsed (from the time t1 to a time t3). The prescribed period is, for example, 30 minutes.

As a result, condensation inside the case 20 can be suppressed while suppressing discomfort due to the driving noise of the fan 42, even when other users frequently enter the toilet room and switch with the user after the use by the user has ended.

When the user uses the toilet device 10, the humidity inside the toilet 2 is increased by excrement, the body temperature of the user, etc. Also, the private part washing nozzle 55 (see FIG. 9) that discharges warm water toward a private part of the user may become wet with moisture, which may increase the humidity inside the case 20 when the nozzle 55 is stored inside the case 20.

Therefore, the fan 42 continues to be driven after the user has left the toilet seat 12. In the first period after the user has left the toilet seat 12, deodorizing can be performed efficiently by increasing the rotational speed of the fan 42. In the second period after the first period has elapsed, the fan 42 is driven at the rotational speed N2 that is less than the prescribed rotational speed (the rotational speed N1) of the first period.

As a result, the driving noise of the fan 42 in the second period can be less than the driving noise of the fan 42 in the first period. Therefore, condensation inside the case 20 can be suppressed while suppressing discomfort due to the driving noise of the fan 42 even when the user is inside the toilet room in which the toilet device 10 is disposed when the moisture is suctioned in the second period, or when other users enter the toilet room and switch with the user after the use by the user has ended.

Then, at the time t3 when the second period has elapsed from the time t2, the controller 15 stops driving the fan 42. As a result, the toilet device 10 can deodorize efficiently, and condensation inside the case 20 can be suppressed. When the human body detection sensor (the seating detection sensor 13) detects the user between the time t2 and the time t3 (in the second period), the rotational speed N2 of the fan 42 is changed to the rotational speed N1; and the control processing from the time t0 is performed.

According to the toilet device 10 according to an embodiment of the invention, the second opening part 31 has a smaller opening area than the first opening part 28. Therefore, when the fan 42 is driven, the airflow rate suctioned through the second opening part 31 can be less than the airflow rate suctioned through the first opening part 28. Accordingly, by including the second opening part 31 in the deodorizing device 40, degradation of the suction ability of the first opening part 28 can be suppressed while suppressing condensation due to the moisture inside the case 20.

According to the toilet device 10 according to an embodiment of the invention, the fan 42 rotates at a prescribed rotational speed from when the user leaves the toilet seat 12 until the first period has elapsed, and rotates at a lower rotational speed than the prescribed rotational speed from when the first period has elapsed until the second period has elapsed. As a result, the driving noise of the fan 42 in the second period can be less than the driving noise of the fan 42 in the first period. Therefore, condensation inside the case 20 can be suppressed while suppressing discomfort due to the driving noise of the fan 42 even when the user is inside the toilet room in which the toilet device 10 is disposed when the moisture is suctioned in the second period, or when another user has entered the toilet room and switched with the user after the use by the user has ended.

For example, if the fan 42 that is being driven as a condensation countermeasure is stopped by using a remote control, etc., the likelihood of condensation occurring inside the case 20 is high. Here, by reducing the discomfort described above, the likelihood that such a fan 42 that is being operated would be undesirably stopped by the use of a remote control, etc., can be reduced.

According to the toilet device 10 according to an embodiment of the invention, the case 20 further includes the fourth opening part 32 configured to pass the air from outside the case 20 and inside the case 20. As a result, the air inside the case 20 can flow out easily, the air outside the case 20 can flow in easily, and the air pressure difference between the interior and outside of the case 20 can be reduced. Because the gap 44 that connects the interior and outside of the case 20 is included in the case 20, there is a risk that moisture may flow more easily through the gap 44 into the case 20 when, for example, the interior of the case 20 has a negative pressure due to the air being suctioned through the second opening part 31; however, the moisture can be prevented from flowing into the case 20 by reducing the air pressure difference between the interior and outside of the case 20. Also, because the fourth opening part 32 connects the outside of the toilet 2 and the interior of the case 20, the moisture can be prevented from flowing into the case 20 from the interior of the toilet 2 via the fourth opening part 32 compared to when the interior of the toilet 2 and the interior of the case 20 are connected.

According to the toilet device 10 according to an embodiment of the invention, the filter 45 that includes the mesh 46 is included. Therefore, the penetration of dirt and/or dust into the interior of the case 20 by passing through the fourth opening part 32 can be suppressed, even when the interior of the case 20 has a negative pressure due to the air being suctioned through the second opening part 31.

According to the toilet device 10 according to an embodiment of the invention, the deodorizing device 40 includes the rib 50 suppressing the suction of air toward the second opening part 31 from a prescribed direction. As a result, the rib 50 can suppress the suction toward the second opening part 31 from the prescribed direction; and air can be preferentially suctioned from a direction other than the prescribed direction. By suppressing the suction of air from a direction connecting the second opening part 31 and locations inside the case 20 where condensation does not easily occur, the moisture inside the case 20 at locations where condensation easily occurs can be preferentially suctioned. Accordingly, condensation inside the case 20 can be suppressed, and component layout constraints inside the case 20 such as needing to mount electronic components inside the case only at locations where condensation does not easily occur, performing potting of the electronic components, etc., can be suppressed.

Figure 11:
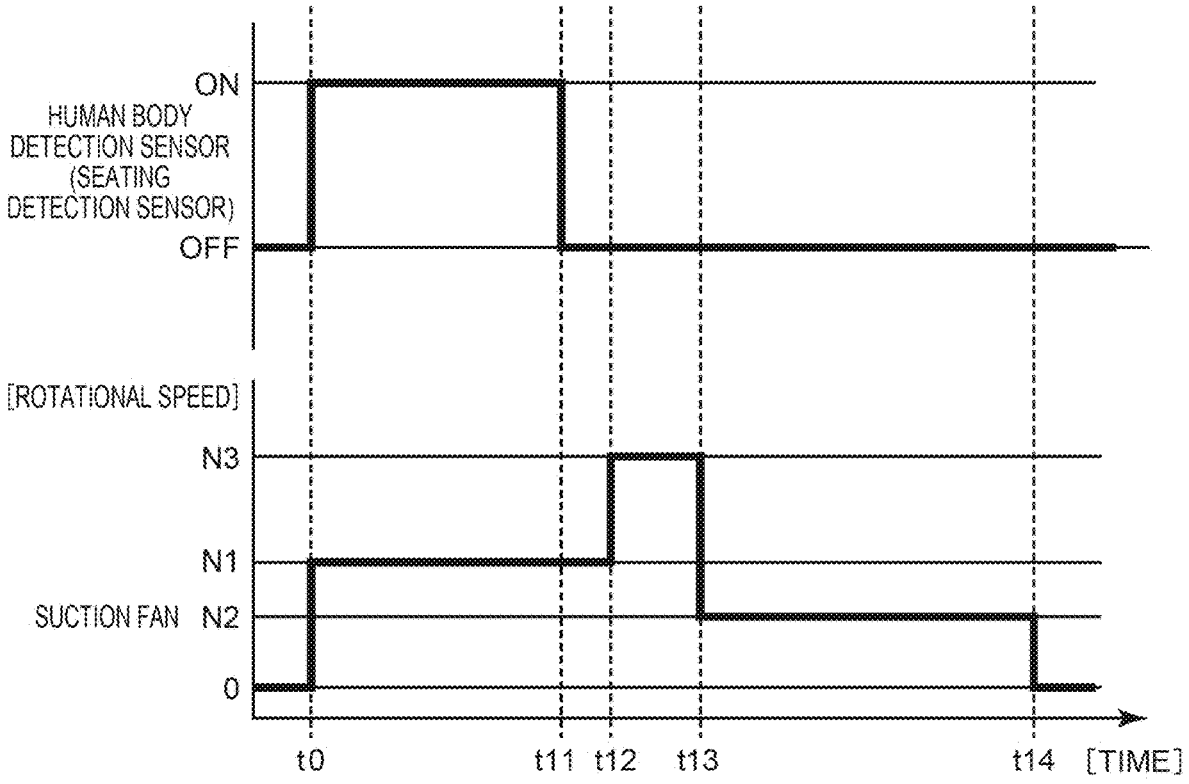
FIG. 11 is a time chart showing the detection state of the human body detection sensor and the driving state of the suction fan of the toilet device according to the modification.

FIG. 11 is a time chart showing the detection state of the human body detection sensor and the driving state of the suction fan of the toilet device according to the modification.

According to the embodiment above, an example is described in which the rotational speed (the output) of the fan 42 is modified in the two stages of the first and second periods. However, aspects of the invention are not limited thereto; for example, as in the modification shown in FIG. 11, the driving of the fan 42 may be controlled in three stages.

Specifically, at the time t0, the seating detection sensor 13 (the human body detection sensor) is switched on (seated). When receiving the seating signal transmitted from the seating detection sensor 13, the controller 15 transmits the first drive signal toward the fan 42. When receiving the first drive signal, the fan 42 starts operating at the rotational speed N1 (e.g., 3,700 rpm).

As a result, the deodorizing device 40 can reduce odorous components based on feces and/or urine of the user. The humidity inside the toilet 2 is increased by the user being seated on the toilet seat 12. By starting to drive the fan 42 when the user is seated on the toilet seat 12, the toilet device 10 can suppress the increase of the humidity inside the case 20 by smoothly circulating the air inside the case 20.

At a time t11, the seating detection sensor 13 (the human body detection sensor) is switched off (unseated). When receiving the unseated signal transmitted from the seating detection sensor 13, the controller 15 measures (counts) the first period. The first period is several seconds to several minutes (e.g., 10 seconds), and is prestored in the storage part of the controller 15.

At a time t12 when the first period has elapsed from the time t11, the fan 42 is driven at a rotational speed N3 (e.g., 6,300 rpm). The rotational speed N3 is, for example, the maximum output value of the fan 42. In other words, when the first period has elapsed from when the user left the toilet seat 12, the controller 15 transmits a maximum drive signal toward the fan 42. When receiving the maximum drive signal, the fan 42 increases the rotational speed from the rotational speed N1 to the rotational speed N3. It is sufficient for the rotational speed N3 to be greater than the rotational speed N1; the rotational speed N3 may not be the maximum output value of the fan 42.

The controller 15 measures (counts) the second period from the time t12. The second period is set to be longer than the first period, and is prestored in the storage part of the controller 15. The second period is from several tens of seconds to several minutes (e.g., 60 seconds). The second period may be set to be shorter than the first period.

For example, the second period is set by assuming the period from when the user using the toilet device 10 leaves the toilet device 10 until the next user uses the toilet device 10. In other words, the second period is the user switching period. The toilet device 10 can suction as much offensive odor and/or moisture as possible by increasing the output of the fan 42 in the second period when a user is not inside the toilet room.

At a time t13 when the second period has elapsed from the time t12, the fan 42 is driven at the rotational speed N2 (e.g., 1,900 rpm). In other words, the controller 15 transmits the second drive signal toward the fan 42 when the second period has elapsed. When receiving the second drive signal, the fan 42 reduces the rotational speed from the rotational speed N3 to the rotational speed N2. The controller 15 measures (counts) the third period from the time t13. The third period is set to be longer than the first and second periods, and is prestored in the storage part of the controller 15. The third period is several minutes to several tens of minutes (e.g., 30 minutes).

Then, at a time t14 when the third period has elapsed from the time t13, the controller 15 stops the driving of the fan 42. As a result, the toilet device 10 can efficiently deodorize, and can suppress condensation inside the case 20. According to the modification, the driving of the fan 42 is controlled by assuming whether or not the user is proximate to the toilet device 10. Accordingly, the toilet device 10 considers the noise based on the driving noise of the fan 42 as well as the deodorizing performance and the condensation suppression of the electronic components inside the case 20.

When the human body detection sensor (the seating detection sensor 13) detects the user between the time t12 and the time t14 (in the second and third periods), the rotational speeds N3 and N2 of the fan 42 are changed to the rotational speed N1; and the control processing from the time t0 is performed.

According to the toilet device 10 according to the modification, the second period is shorter than the third period. As a result, offensive odors and/or moisture can be suctioned as much as possible in the second period in which the person has left the seat and is not inside the toilet room. The fan 42 can be prevented from being driven at a higher rotational speed than the prescribed rotational speed for a long period of time; and discomfort of the person due to the driving noise can be further suppressed.

Examples are described in the embodiments and modifications described above in which the rotational speed of the fan 42 is changed in two stages or three stages. However, aspects of the invention are not limited thereto; for example, the rotational speed of the fan 42 may be changed in four or more stages.

Embodiments may include the following configurations.

Configuration 1

A toilet device, comprising:

a case; and a deodorizing device disposed inside the case, the deodorizing device including a first opening part configured to suction air outside the case, a second opening part configured to suction air inside the case, a third opening part configured to exhaust, out of the case, air suctioned by the first and second opening parts, a suction fan configured to suction the air outside and inside the case through the first and second opening parts, a first deodorizing path part connecting the suction fan with the first and second opening parts, and a second deodorizing path part connecting the suction fan and the third opening part, the second opening part having a smaller opening area than the first opening part.

Configuration 2

The toilet device according to Configuration 1, further comprising:

a human body detection sensor configured to detect a human body, the suction fan rotating at the prescribed rotational speed from when the human body detection sensor changes from a state of detecting a human body to a state of not detecting the human body until a first period has elapsed, and rotating at a lower rotational speed than the prescribed rotational speed from when the first period has elapsed until a second period has elapsed.

Configuration 3

The toilet device according to Configuration 1, further comprising:

a human body detection sensor configured to detect a human body, the suction fan rotating at a prescribed rotational speed from when the human body detection sensor changes from a state of detecting a human body to a state of not detecting the human body until a first period has elapsed, rotating at a higher rotational speed than the prescribed rotational speed from when the first period has elapsed until a second period has elapsed, and rotating at a lower rotational speed than the prescribed rotational speed from when the second period has elapsed until a third period has elapsed.

Configuration 4

The toilet device according to Configuration 3, wherein the second period is shorter than the third period.

Configuration 5

The toilet device according to any one of Configurations 1 to 4, wherein the case further includes a fourth opening part configured to pass the air from outside the case and inside the case.

Configuration 6

The toilet device according to Configuration 5, wherein a filter including a mesh is disposed in the fourth opening part.

Configuration 7

The toilet device according to any one of Configurations 1 to 6, wherein the deodorizing device further includes a rib configured to suppress a suction of air from a prescribed direction toward the second opening part.

Configuration 8

The toilet device according to Configuration 1, further comprising:

a human body detection sensor configured to detect a human body, the suction fan rotating at a prescribed rotational speed when the human body detection sensor detects a human body, when the human body detection sensor no longer detects the human body, the suction fan rotating at a lower rotational speed than the prescribed rotational speed from when the human body is no longer detected until a prescribed period has elapsed.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. For example, the shape, the dimension, the material, the disposition, the installation feature or the like of the components included in the toilet device is not limited to the illustration and can be appropriately modified. The components included in the embodiments described above may be combined within the extent of technical feasibility, and any combinations of these components also are included in the scope of the invention to the extent that they include the feature of the invention.

What is claimed is:

1. A toilet device, comprising:

a case; and a deodorizing device disposed inside the case, the deodorizing device including a first opening part configured to suction air outside the case, a second opening part configured to suction air inside the case, a third opening part configured to exhaust, out of the case, air suctioned by the first and second opening parts, a suction fan configured to suction the air outside and inside the case through the first and second opening parts, a first deodorizing path part connecting the suction fan with the first and second opening parts, and a second deodorizing path part connecting the suction fan and the third opening part, the second opening part having a smaller opening area than the first opening part.

2. The toilet device according to claim 1, further comprising:

a human body detection sensor configured to detect a human body, the suction fan rotating at the prescribed rotational speed from when the human body detection sensor changes from a state of detecting a human body to a state of not detecting the human body until a first period has elapsed, and rotating at a lower rotational speed than the prescribed rotational speed from when the first period has elapsed until a second period has elapsed.

3. The toilet device according to claim 1, further comprising:

a human body detection sensor configured to detect a human body, the suction fan rotating at a prescribed rotational speed from when the human body detection sensor changes from a state of detecting a human body to a state of not detecting the human body until a first period has elapsed, rotating at a higher rotational speed than the prescribed rotational speed from when the first period has elapsed until a second period has elapsed, and rotating at a lower rotational speed than the prescribed rotational speed from when the second period has elapsed until a third period has elapsed.

4. The toilet device according to claim 3, wherein the second period is shorter than the third period.

5. The toilet device according to claim 1, wherein the case further includes a fourth opening part configured to pass the air from outside the case and inside the case.

6. The toilet device according to claim 5, wherein a filter including a mesh is disposed in the fourth opening part.

7. The toilet device according to claim 1, wherein the deodorizing device further includes a rib configured to suppress a suction of air from a prescribed direction toward the second opening part.

8. The toilet device according to claim 1, further comprising:

a human body detection sensor configured to detect a human body, the suction fan rotating at a prescribed rotational speed when the human body detection sensor detects a human body, when the human body detection sensor no longer detects the human body, the suction fan rotating at a lower rotational speed than the prescribed rotational speed from when the human body is no longer detected until a prescribed period has elapsed.

* * * * *